US005383736A

United States Patent [19]

Okulov

[11] Patent Number: 5,383,736

[45] Date of Patent: Jan. 24, 1995

[54] WRITING INSTRUMENT WITH PLURAL FEEDS

[76] Inventor: Pavel D. Okulov, 198 Profsousnoya St. #118-1, Moscow, U.S.S.R.

[21] Appl. No.: 942,968

[22] Filed: Sep. 10, 1992

[30] Foreign Application Priority Data

Sep. 11, 1991 [SU] U.S.S.R. ..... 5002934

[51] Int. Cl.[6] ..... B43K 7/00; B43K 7/10; B43K 27/12

[52] U.S. Cl. ..... 401/45; 401/47; 401/209; 401/219

[58] Field of Search ..... 401/44–47, 401/209, 219; 222/560, 537

[56] References Cited

U.S. PATENT DOCUMENTS

| | | | |
|---|---|---|---|
| 1,383,416 | 7/1921 | Mukojima | 401/45 |
| 1,426,909 | 8/1922 | Rayder | 401/183 |
| 1,737,954 | 12/1929 | Wilson | 401/45 |
| 1,797,465 | 3/1931 | Biasi | 401/45 |
| 2,130,978 | 9/1938 | White | 401/45 |
| 2,427,033 | 9/1947 | Wahl . | |
| 2,594,083 | 4/1952 | Silver | 401/209 X |
| 2,642,042 | 6/1953 | Gowland | 401/45 |
| 2,661,870 | 12/1953 | Huenergardt | 401/47 X |
| 2,753,641 | 7/1956 | Dorman . | |
| 2,866,580 | 12/1958 | Nissen | 222/560 X |
| 2,946,312 | 7/1960 | Craig | 401/44 |
| 3,094,105 | 6/1963 | Jenkins | 401/47 |
| 3,508,682 | 4/1970 | Hollis et al. . | |
| 3,518,018 | 6/1970 | Woods . | |
| 3,942,902 | 3/1976 | Pajala et al. . | |
| 4,217,062 | 8/1980 | Trp et al. . | |
| 5,122,056 | 6/1992 | Barbee | 433/80 |

FOREIGN PATENT DOCUMENTS

| | | | |
|---|---|---|---|
| 990028 | 9/1951 | France | 401/44 |
| 1006772 | 4/1952 | France | 401/281 |
| 512533 | 8/1928 | Germany | 401/45 |
| 2514966 | 10/1976 | Germany | 401/45 |
| 470418 | 5/1950 | Italy | 222/560 |
| 108969 | 8/1917 | United Kingdom | 401/45 |
| 711796 | 7/1954 | United Kingdom | 401/45 |
| 8601700 | 3/1986 | WIPO | 222/560 |

*Primary Examiner*—Steven A. Bratlie
*Attorney, Agent, or Firm*—Samuels, Gauthier & Stevens

[57] ABSTRACT

A writing instrument including a body having at its distal end a saddle portion in which a writing element, for example a ball, is placed, and a feeding element with a plurality of channels through which mixing components may pass for application to a surface by the writing element. The feeding element is configured with the body so that the body is rotatable about the feeding element. There is provided at least one opening or passageway in the body position between the feeding element and the writing element wherein the mixing of the components takes place.

1 Claim, 1 Drawing Sheet

WRITING INSTRUMENT WITH PLURAL FEEDS

BACKGROUND OF THE INVENTION

The invention relates to equipment which can be used in multi-color ball-point pens for writing and drawing, and also in devices for application, on various surfaces, of compounds consisting of different components, in particular glues, cosmetics, perfumes, and the like.

The prior art includes a device for multi-color writing, which consists of a set of writing units, each having an ink tube or the like containing a different-colored ink. The writing units are combined in a single pen body, and are interchangeable one with the other to enable differently colored inks to be applied to a writing surface. Among the disadvantages of such a device is its complexity arising from the need to use a special mechanism for exchanging the writing units, and also the difficulty of obtaining intermediate color shades. Another conventional design of a writing instrument for the writing device as described above consists of a body with a saddle in which a ball is placed to be used as a writing element and a feeding element with channels used to supply colored components to the ball. A disadvantage of such a device is that there is no way of reliably obtaining different colors or compositions with such a configuration.

SUMMARY OF THE INVENTION

Accordingly, an object of the present invention is to enhance the functional capabilities of the conventional multi-color writing instruments and other like devices.

It is another object of the invention to provide a writing instrument or like device which obtains any desired color shade or mixture of components with gradual shading or tuning by combining constituent components in predetermined proportions.

These objectives and others are achieved by the present invention, which comprises in a preferred embodiment a writing instrument including a body having at its distal end a saddle portion in which a writing element preferably in the form of a solid of revolution, for example a ball, is placed, and a feeding element with a plurality of channels through which mixing components may pass for application to a surface by the writing element. The body and the feeding element have a common contacting surface, for example a spherical surface, situated at the side of the feeding element at which the channels end. The feeding element is configured with the body so that the body is rotatable about the feeding element. There is provided at least one opening or passageway in the body positioned between the feeding element and the writing element wherein the mixing of the components takes place.

The present invention allows for the obtaining any chromatic tone which is possible to be obtained from the given colored components, and also mixing in given proportions and applying on the surface of other components and compositions.

In order to simplify the color tuning in an alternative embodiment, the invention may include a gate device having one or several openings, which is situated between the confronting surfaces of the feeding element and the body, and being capable of displacement with respect to the feeding element and the body.

BRIEF DESCRIPTION OF THE DRAWINGS FIG. 1 and 1A show longitudinal sectional views of a writing unit in accordance with preferred embodiments of the present invention; and FIG. 2 shows a longitudinal sectional view of an alternative embodiment of the writing unit.

DETAILED DESCRIPTION OF THE ILLUSTRATED EMBODIMENTS

Figure 1:
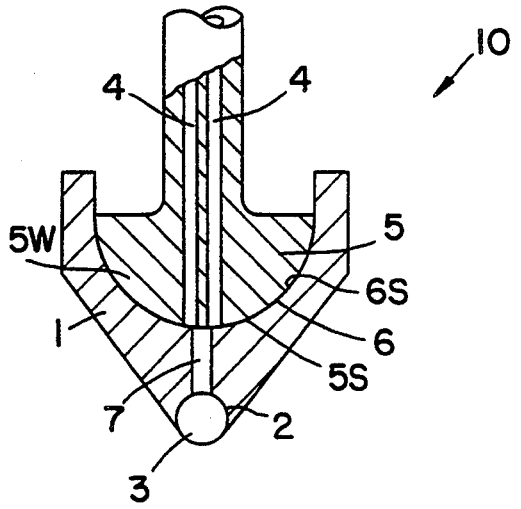
Figure 1A:
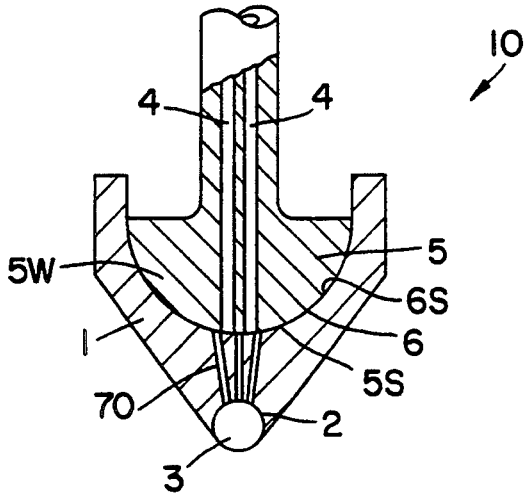

With reference now to FIG. 1, a writing instrument 10 according to the present invention is shown. The writing instrument includes a body 1 having at one end thereof a saddle portion defining an outlet port 2. An application element 3, preferably in the form of a solid of revolution or ball, is captured within the outlet port. The other end of the body 1 is configured to define a spherically shaped reception port 6 having an inner surface 6*s*. A passageway 7 extends through the body and connects the outlet port 2 to the reception port 6. It will be appreciated that several passageways 70 may be provided between the reception port and the discharge port as shown in FIG. 1A.

The writing instrument 10 also includes a feeding element 5 having at one end a spherically shaped head portion 5*h* with an outer contacting surface 5*s*. The head portion 5*h* is received within the reception port 6 of the body. Therefore, the body 1 is rotatable with respect to the feeding element 5. The sliding contact between the surface 6*s* of the reception port and the surface 5*s* of the head portion of the feeding element 5 provides a liquid seal between the body 1 and the feeding element 5. The feeding element 5 also includes multiple channels 4 passing therethrough and leading to the interface between surfaces 5*s*, 6*s* for supplying desired mixing components to the writing element 3 via passageway 7. For example, the channels 4 may be filled with inks of different colors.

The operation of the writing instrument 10 is as follows. In order to obtain the necessary color and composition of the component mixture, the body 1 is rotated in relation to the head portion 5*h* in order to align the passageway 7 with one or more of the channels 4, thereby allowing one or several differently colored inks to flow into passageway 7. The passageway 7 serves as a mixing chamber for the components simultaneously being supplied from the channels 4, thus providing fast mixture of the mixing components so as to produce the desired color shade or composition at the writing element 3. Once the writing element 3 is pressed down on and moved over a surface of paper or other material, the writing element rotates within the discharge port 2 and thereby leaves a trace of the mixed components of the desired color or composition.

Figure 2:
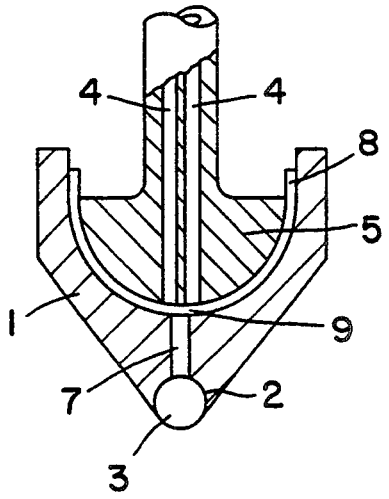

With reference to FIG. 2, an alternative embodiment of the writing instrument 10 is shown with displaceable gate portion 8 disposed between the contact surface 6*s* of the body 1 and the contact surface 5*s* of the head portion 5*h* of the feeding element 5. The gate 8 is slidably displaced between various positions along the contact surfaces, and is displaced in order to vary the exposure of the channels 4 to the passageway 7, thus allowing for control of the desired mixing ratios of the components fed from the channels. It will be appreciated that the gate 8 may be provided with several openings in order to further vary the amounts of the components from the channels 4 being supplied to the passageway.

What is claimed is:

1. A writing instrument comprising:

a body having a reception port in the form of a concave surface, an outlet port, and at least one connecting passageway extending therebetween along a central axis;

an application element in the form of a solid revolving ball captured within said outlet port;

a feeding element defining a convex surface received in contacting relation with the concave surface of said reception port, said body being movable both angularly with respect to said axis and rotationally in relation to said feeding element along an interface defined at the contact between said concave and convex surfaces, said feeding element having a plurality of channels leading to said interface and adapted to be filled with distinct mixing components, said mixing components comprising inks of differing colors, wherein movement of said body in relation to said feeding element will result in alignment of at least one passageway with at least one of said channels, thereby allowing selected ratios of said mixing components to be admitted to said passageway for ultimate application by said application element, and a displaceable gate disposed between said feeding element and said reception port and having at least one opening for varying amounts of said components from each channel being supplied to said at least one passageway.

* * * * *